United States Patent [19]

L'Hermite et al.

[11] Patent Number: 4,987,336

[45] Date of Patent: Jan. 22, 1991

[54] REVERSIBLE SHORT-CIRCUIT AND THE USE OF SAID SHORT-CIRCUIT IN A PHOTOELECTRIC TUBE

[75] Inventors: Pierre L'Hermite; Michel Vergne; Alain Escapoulade, all of Brive, France

[73] Assignee: U.S. Philips Corp., New York, N.Y.

[21] Appl. No.: 62,923

[22] Filed: Jun. 16, 1987

[30] Foreign Application Priority Data

Jul. 23, 1986 [FR] France ..... 86 10691

[51] Int. Cl.[5] ..... H01J 43/00

[52] U.S. Cl. ..... 313/105 R; 313/104; 313/106; 337/89; 337/88

[58] Field of Search ..... 313/105 CM, 105 R, 106, 313/104, 103 CM, 103 R; 337/89, 88, 85, 36, 12; 315/149, 158, 312

[56] References Cited

U.S. PATENT DOCUMENTS 3,497,839 2/1970 Jakobs ..... 337/89
4,220,938 9/1980 Grable ..... 337/89
4,528,540 7/1985 Stiekel et al. ..... 357/89
4,551,701 11/1985 Ubukata et al. ..... 337/89
4,620,175 10/1986 Karr et al. ..... 337/89

OTHER PUBLICATIONS

McGraw-Hill Dictionary of Scientific and Technical Terms, 1978, p. 638.

*Primary Examiner*—Michael Razavi
*Attorney, Agent, or Firm*—William L. Botjer

[57] ABSTRACT

A reversible short circuit device in the form of a metal loop. The metal loop has a first base side which forms a first contact. Extending from the base side are second and third generally parallel sides. The second side includes a contact portion for engagement with an external object to provide an electrical connection therewith. The second and their sides are connected by a frangible fourth connection side. One of the second and third sides is subject to a recoiling force, which, when the connection side is interrupted or broken displaces the contact portion of the second side so as to reverse the short circuit. The short circuit device has particular application to photoelectric tubes to provide a means for interconnection of the tube components during manufacture, which may subsequently be reliably disconnected.

6 Claims, 1 Drawing Sheet

REVERSIBLE SHORT-CIRCUIT AND THE USE OF SAID SHORT-CIRCUIT IN A PHOTOELECTRIC TUBE

BACKGROUND OF THE INVENTION

The present invention relates to a short-circuit device which is reversible by recoiling. The invention also relates to the use of the short circuit in a photoelectric tube provided with a photocathode and having a Joule effect evaporator of a material constituting the photocathode.

The technical problem to be solved with any short-circuit which is reversible by recoiling, notably remotely reversible short-circuits, is to obtain a device which is not very bulky, is inexpensive and, above all, is reliable in the sense that the short-circuit can be reversed with great reliability. French Patent Specification No. 81 22 380 describes a short-circuit which reversible by recoiling and is constituted by a fusible conductor wire which is subjected to tensile stress a tensile force and which breaks after fusion by heating by means of a high frequency radiation. This known short-circuit has the advantage of having small dimensions and being inexpensive. However, it has proved to have insufficient reliability with too weak heating and due to the difficulty of obtaining a reproducible tensile force.

The general technical problem to be solved by the present invention is to realize a short-circuit which is reversible by recoiling, is inexpensive, is not bulky and is reliable, notably when remotely reversed by means of a high-frequency radiation. An advantageous embodiment of the short-circuit according to the invention comprises a photoelectric tube provided with a photocathode and having a Joule effect evaporator of a material constituting the photocathode and at least two dynodes each held at an electric potential via polarization conductors. The present Application propounds as its particular technical problem to be solved the capability of using the conductors of the dynodes to evaporate, by the Joule effect, the material constituting the photocathode without increasing the number of lead-throughs in the base of the photoelectric tube.

SUMMARY OF THE INVENTION

According to the object of the present invention, the solution to the general technical problem consists in a short-circuit device which is reversible by recoiling, having the form of a metalic loop constituted by a first side, termed the base side, forming a first short-circuit contact from which a second and a third side extend substantially in parallel. The second side, termed the long side, is longer than the third side, termed the short side. The end of the long side includes a second short-circuit contact portion. The long and short sides are rigidly connected by a fourth frangible side, termed the connection side. At least the long side is subjected to a recoiling force which, when the connection side is interrupted, i.e. broken moves the end of the long side with respect to the said base side in such a manner that the short circuit is reversed. The loop shape of the short-circuit, according to the invention, advantageously permits the use a high-frequency radiation to interrupt the connection side. The current induced in the loop by the high-frequency radiation produces, by the Joule effect, a heating and melting of the metal and. In order that the heating be maximized at the level of the connection side, the connection side has a narrow poriton which is interrupted when a current is induced in the loop by a high-frequency flash.

The solution to the particular technical problem to be solved provides that, the material to be evaporated is placed between a first dynode and the polarization conducdtor of the dynode, one short-circuit contact is made on the first dynode and another contact of the short-circuit is made on the second dynode. By thus short-circuiting the two dynodes, the conductors of said two dynodes may be used to evaporate, by the Joule effect, the material constituting the photocathode. After evaporation the two dynodes are made electrically independent by reversing the short-circuit according to the invention.

BRIEF DESCRIPTION OF THE DRAWINGS

From the following description with reference to the accompanying drawings, given by way of a non-limiting example, it will be understood what the invention consists of and how it can be realized.

DESCRIPTION OF THE PREFERRED EMBODIMENTS

Figure 1A:
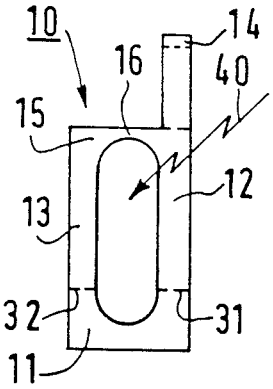
FIG. 1 is an elevational view of a reversible short-circuit according to the invention.
FIGS. 1*b* and 1*c* are side views of the short-circuit of FIG. 1*a* in the closed and open positions, resspectively.
Figure 1B:
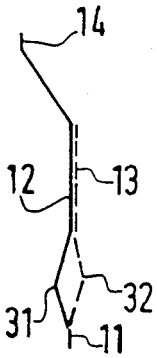

FIG. 1*a* is an elevation of a short-circuit 10 which is reversible by recoiling. As may be seen from FIG. 1*a*, the short-circuti 10 has the form of a metal loop constituted by a first side 11, termed the base side, which produces a first short-circuit contact. From the base side 11 a second side 12 and a third side 13 extend substantially in parallel one of which, side 12, termed the long side, is longer than side 13, termed the short side. The end 14 of the long side 12 forms a second short-circuit contact. The long side 12 and the short side 13 are subjected to recoiling forces indicated by the arrows 21 and 22 in FIG. 1*c*. In the example shown in FIGS. 1*a*, 1*b*, and 1*c* the recoiling forces 21 and 22 are generated by bends 31 and 32 of the metal constituting the metal loop. In the initial position the long and short sides are also connected rigidly by a frangible side 15, termed the connection side, in such a manner as to give the loop a substantially flat shape as is shown in FIG. 1*b*. When the connection side 15 is interrupted the recoiling forces 21 and 22 separate the sides 12 and 13 on both sides sof the plane of the initial loop. Specifically, the force 21 moves the end 14 of the long side 12 with respect to the said base side 11 so as to reverse the short circuit.

The loop shape of short circuit 10 permits the efficacious use of a high-frequency flash 40 as the rupture means of the connection side 15. The current induced by the said high-frequency flash produces, by the Joule effect, the heating and then the rupture of the loop by melting the metal. In order to localize the rupture at the level of the connection side 15, the latter has a narrow portion 16. In this manner the electrical resistance of the loop and hence the Joule effect is augmented at that area. Moreover, said the narrowed portion also permits a reduction of the quantity of melted metal which is particularly advantageous when short-circuit 10 is used in an evacuated space and degassing is to be avoided, as is the case in a photoelectric tube.

Figure 1C:
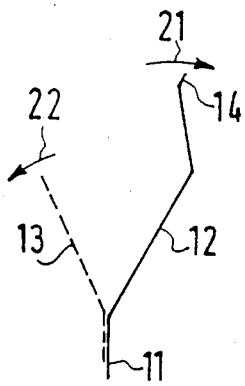
Figure 2:
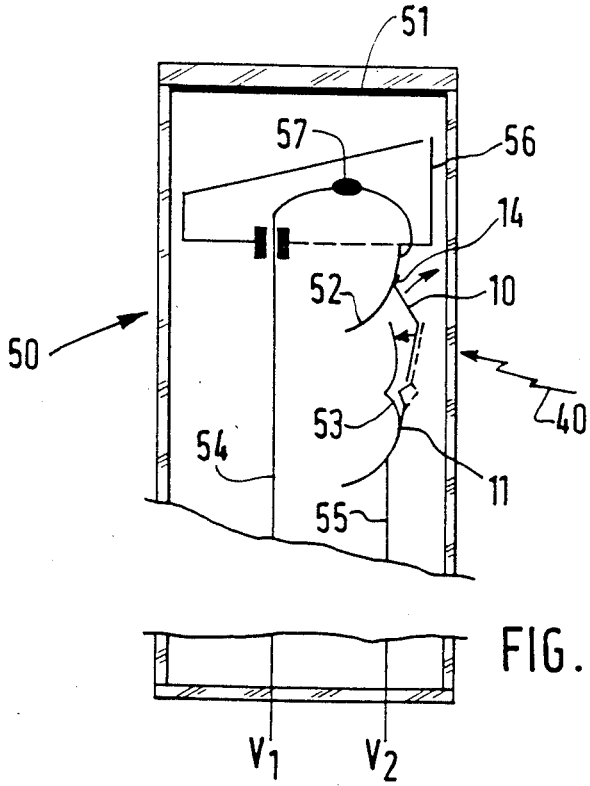
FIG. 2 is sectional view of a photomultiplier tube comprising the short-circuit of FIGS. 1*a*, 1*b*, 1*c* .

FIG. 2 is a diagrammatic sectional view of the short-circuit shown in FIGS. 1*a*, 1*b* and 1*c* embodied in a photoelectric tube 50. Tube 50 includes a photocathode 51 and at least two dynodes 52, 53 each held at an electric potential V1, V2 via polarization conductors 54, 55. The photoelectric tube moreover has a focusing electrode 56 by which the electrons issued by the photocathode on the dynode 52 are made to converge. A Joule effect evaporator 57 of a material constituting the photocathode, for example antimony, is connected at one end to the polarization conductor 54 of the dynode 52 and to the dynode 52 itself. During the construction of the tube the short-circuit 40 is disposed as is shown in FIG. 2: short-circuit contact 14 is realized by elastic pressure on the dynode 52, while the contact 11 is produced by soldering to the other dynode 53. The tube 50 is then evacuated and sealed. Before applying the electric potentials V1 and V2, the evaporation circuit is closed at a voltage permitting the passage of a current is sufficient to evaporate the constituent 57. When the evaporation occurs, the evaporation circuit is interrupted by reversing the short-circuit 10 by applying a high-frequency flash 40. The short-circuit then assumes the position illustrated in FIG. 1*c*, the contact 14 moves away from the dynode 52, while the free end of the short side 13 is supported by the dynode 53 which in the case of FIG. 2 is in two parts. The dynodes 52 and 53, may then be brought to the potentials V1 and V2.

What is claimed is:

1. A reversible short circuit device comprising a metal loop having a first base side forming a first contact, a second side and a third side spaced apart from each other and extending away from said first side, said second side including a contact portion for engagement with an external object, said second and third sides being connected by a frangible fourth connection side, one of said second and said third sides being subject to a recoiling force when said fourth side is interrupted to thereby displace said contact portion of said second side out of engagement with said external object.

2. The short circuit device as claimed in claim 1 wherein said frangible fourth connection side includes a narrowed portion constructed and arranged to be interrupted when a current is induced in said metal loop by high frequency radiation.

3. The short circuit device as claimed in claim 1 wherein said third side of said metal loop is subjected to a recoiling force opposite in direction to the recoiling force to which the second side is subjected.

4. The shsort circuit device as claimed in claim 1 wherein said metal loop includes a bent poriton constructed and arranged to provide said recoiling force to at least one of said second and third sides.

5. The shsort circuit device as claimed in claim 1 wherein said device is disposed within a photoelectric tube having first and second conductors and first and second dynodes, said first conductor being connected to said first dynode, said second conductor being connected to said second dynode, said short circuit device being disposed between said first and said second dynodes, said contact portion of said second side being in electrical contact with said first dynode, the remaining portion of said short circuit device being in electrical contact with said second dynode to electrically connect said first dynode to said second dynode, upon interruption of said fourth connecting side said contact portion being displaced away from said first dynode by said recoiling force to therby disconnect said first dynode from said second dynode.

6. The short circuit device as claimed in claim 5 wherein said conductor connected to said first dynode of said photoelectric tube includes material which is evaporatable by a current passing between said first and second conductors when said contact portion of said second side of said short circuit device is in contact with said first dynode.

* * * * *